United States Patent [19]

Cohen et al.

[11] 4,019,909

[45] Apr. 26, 1977

[54] PHOTOHARDENABLE VESICULAR IMAGE-FORMING ELEMENTS

[75] Inventors: Abraham Bernard Cohen, Springfield; Leo Roos, New Shrewsbury, both of N.J.

[73] Assignee: E. I. Du Pont de Nemours and Company, Wilmington, Del.

[22] Filed: June 21, 1972

[21] Appl. No.: 264,951

Related U.S. Application Data

[63] Continuation of Ser. No. 11,887, Feb. 16, 1970, abandoned.

[52] U.S. Cl. ..... 96/115 P; 96/48 HD; 96/85; 96/87 R; 96/115 R

[51] Int. Cl.[2] ..... G03C 1/68

[58] Field of Search ..... 96/91 R, 91 N, 91 D, 96/75, 115 P, 115 R, 67, 88

[56] References Cited

UNITED STATES PATENTS

| | | | |
|---|---|---|---|
| 2,684,341 | 7/1954 | Anspow et al. | 96/91 R X |
| 2,852,379 | 9/1958 | Hepher et al. | 96/91 N |
| 2,911,299 | 11/1959 | Baril et al. | 96/75 X |
| 2,996,381 | 8/1961 | Oster et al. | 96/115 P X |
| 3,108,872 | 10/1963 | McMahon | 96/91 R |
| 3,171,744 | 3/1965 | Peticolas | 96/115 R X |
| 3,183,091 | 5/1965 | Sporer et al. | 96/115 R X |
| 3,252,796 | 5/1966 | Lindquist et al. | 96/75 X |
| 3,260,509 | 7/1966 | Lokken | 96/75 |
| 3,298,833 | 1/1967 | Gaynor | 96/75 X |
| 3,418,118 | 12/1968 | Thommes et al. | 96/115 P X |

*Primary Examiner*—Charles L. Bowers, Jr.

[57] ABSTRACT

A photohardenable thermoplastic stratum containing a thermally activated blowing agent may be used to record images by imagewise exposing the stratum to actinic radiation adapted to polymerize and harden the stratum image-wise, and heating the exposed stratum to soften the unhardened areas and decompose the blowing agent, whereby a positive image of microscopic bubbles is formed in said stratum.

9 Claims, No Drawings

PHOTOHARDENABLE VESICULAR IMAGE-FORMING ELEMENTS

This application is a continuation-in-part of Cohen and Roos Ser. No. 11,887, filed Feb. 16, 1970, now abandoned.

BACKGROUND OF THE INVENTION

This invention relates to vesicular imaging systems and more particularly to improved such systems having greater photospeed and archival permanence and being more convenient to use.

Vesicular imaging elements comprising a thermoplastic binder and photolytic compound which releases gas when decomposed by light are well known. Such elements are imagewise exposed, usually with ultraviolet light, then heated to expand the bubbles in the exposed areas. See, for example, U.S. Pat. No. 3,108,872. In order to fix the image and give it archival permanence photolytic compounds which lose their photosensitivity have been used, e.g., those compounds disclosed in British Pat. No. 968,466. Fixing by destroying the thermoplastic properties of the polymer is disclosed in British Pat. No. 975,456. Prior art processes generally use a photolytic compound to liberate the bubble-forming gas in the polymer matrix; they therefore give a negative image. It has been found in accordance with the present invention that a thermally decomposable gas-liberating compound in a thermosplastic photohardenable matrix without any photolytic blowing agent gives a positive vesicular image.

SUMMARY OF THE INVENTION

It is an object of this invention to provide novel vesicular imaging elements. It is a further object to provide such elements having greater photospeed and archival permanence. A still further object is to provide such elements having photohardenable layers capable of forming positive vesicular images.

The elements comprise a support bearing a solid layer that softens at a temperature (i.e., has a glass transition temperature) between 40° and 220° C., said layer comprising:

a. about 60 to 99% by weight of a thermoplastic photohardenable material and b. about 1 to 40% by weight of a blowing agent which, when heated to at least 75° C., produces a gas that will form small bubbles in areas of said layer which are not photohardened, said blowing agent being substantially stable to actinic radiation by which said photohardenable material is photohardened.

In addition, the layer may contain plasticizers and surfactants. Non-thermoplastic film-forming binders may also be used if they are mixed with a plasticizing agent so that the resulting matrix is thermoplastic or softens at 40° to 220° C.

In use, the element of this invention is exposed through a process transparency to actinic radiation, then heated to a temperature at which the gas-generating blowing agent decomposes or vaporizes and the thermoplastic matrix softens. In the unexposed areas, the gas generated by the blowing agent expands to produce many microscopic bubbles, while the exposed areas remain free of bubbles, thus forming a light-scattering positive vesicular image. In view of the prior art, which generally relates to negative image production, or requires special techniques for a reversal effect, it is surprising that the ordinary materials of the invention are capable of producing a positive image. This result may be attributed to the unexpected ability of the photohardened areas of the layer to suppress bubble formation even when heated, whereas the unexposed areas which are heated to the same temperature do contain bubbles.

DESCRIPTION OF THE PREFERRED EMBODIMENTS

Photohardenable materials suitable for use in the layer of an element of the invention include those in which at least one component undergoes an increase in molecular weight, as by polymerization, crosslinking or dimerization, when exposed to actinic light, as more fully described in U.S. Pat. No. 3,649,268, Col. 2 – Col. 3, issued Mar. 14, 1972, to Chu et al. While photocrosslinkable materials may be used without a binder, photopolymerizable monomers are mixed with a thermoplastic polymer binder so as to produce a thermoplastic solid layer. Preferred photopolymerizable materials comprise 10 to 50% by weight of at least one nongaseous ethylenically unsaturated compound having at least one terminal ethylenic group, having a boiling point above 100° C. at normal atmospheric pressure and being capable of forming a high polymer by photoinitiated addition polymerization and 30 to 80% by weight of at least one film-forming thermoplastic polymer binder. An initiating amount of a suitable photoinitiator is also present.

Preferably the composition also contains at least one photosensitizing compound to increase the photographic speed and may also contain auxiliary compounds such as plasticizers, inhibitors, and surfactants.

Suitable free-radical initiated, chainpropagating addition polymerizable ethylenically unsaturated compounds include preferably an alkylene or a polyalkylene glycol diacrylate prepared from an alkylene glycol of 2 to 15 carbons or a polyalkylene ether glycol of 1 to 10 ether linkages, and those disclosed in Martin and Barney, U.S. Pat. No. 2,927,022, issued Mar. 1, 1960, e.g., those having a plurality of addition polymerizable ethylenic linkages, particularly when present as terminal linkages, and especially those wherein at least one and preferably most of such linkages are conjugated with a doubly bonded carbon, including carbon doubly bonded to carbon and to such heteroatoms as nitrogen, oxygen and sulfur. Outstanding are such materials wherein the ethylenically unsaturated groups, especially the vinylidene groups, are conjugated with ester or amide structures. The following specific compounds are further illustrative of this class; unsaturated esters of alcohols, preferably polyols and particularly such esters of the alpha-methylene carboxylic acids, e.g., ethylene glycol diacrylate, diethylene glycol diacrylate, glycerol diacrylate, glycerol triacrylate, ethylene glycol dimethacrylate, 1,3-propanediol dimethacrylate, 1,2,4-butanetriol trimethacrylate, 1,4-cyclohexanediol diacrylate, 1,4-benzenediol dimethacrylate, penetaerythritol tetramethacrylate, 1,3-propanediol diacrylate, 1,5-pentanediol dimethacrylate, the bis-acrylates and methacrylates of polyethylene glycols of molecular weight 200 – 500, and the like; unsaturated amides, particularly those of the alpha-methylene carboxylic acids, and especially those of alpha-omega-diamines and oxygen-interrupted omega-diamines, such as methylene bis-acrylamide, methylene bis-methacrylamide, ethylene bis-methacrylamide, 1,6-hexamethylene bis-acrylamide, diethylene triamine tris-methacrylamide, bis(gamma-methacrylamidopropoxy) ethane, beta-methacrylamidoethyl methacrylate, N-(beta-hydroxyethyl)-beta-(methacrylamido)ethyl acrylate and N,N-bis(beta-methacryloxyethyl)acrylamide; vinyl esters such as divinyl succinate, divinyl adipate, divinyl phthalate, divinyl terephthalate, divinyl benzene-1,3-disulfonate, and divinyl butane-1,4-disulfonate; styrene and derivatives thereof and unsaturated aldehydes, such as sorbaldehyde (hexadienal). An outstanding class of these preferred addition polymerizable components are the esters and amides of alpha-methylene carboxylic acids and substituted carboxylic acids with polyols and polyamides wherein the molecular chain between the hydroxyls and amino groups is solely carbon or oxygen-interrupted carbon. The preferred monomeric compounds are difunctional, but monofunctional monomers can be used. In addition, the polymerizable, ethylenically unsaturated polymers of Burg, U.S. Pat. No. 3,043,805, Martin, U.S. Pat. No. 2,929,710 and similar materials may be used alone or mixed with other materials. The amount of monomer added varies with the particular polymers used. Acrylic and methacrylic esters of polyhydroxy compounds such as pentaerythritol and trimethylol propane, and acrylic and methacrylic esters of adducts of ethylene oxide and polyhydroxy compounds such as those disclosed in Cohen and Schoenthaler, U.S. Pat. No. 3,380,831 are also useful.

The blowing agent for the layer of the invention may be any material which is stable to the actinic radiation by which the photohardenable material is photohardened (i.e., does not form gas bubbles when exposed to said radiation and does not form gas molecules or other products which would expand into gas bubbles in photohardened areas when heated to the softening point of the photohardenable areas) and which produces gas bubbles in the unexposed areas of said layer when the layer is heated to 75° or more. The blowing agent must produce gas bubbles only in the unexposed areas so that a positive vesicular image will be formed. Preferably, the blowing agent produces the gas bubbles by vaporizing or decomposing when heated to temperatures of 75° – 140° C. or more. In the case of a polymerizable layer with a photoinitiator sensitive to actinic light, the blowing agent is stable to the actinic light by which the photoinitiator is activatable. Of the many blowing agents known in the art, there may be mentioned as representative examples, alkali oxalates and ammonium salts of polycarboxylic acids and of certain inorganic acids such as sulfuric and carbonic acids. Also useful are organic compounds such as 4-ketobenzotriazine and inert organic compounds of low boiling point such as the fluorinated and chlorinated hydrocarbons of relatively low molecular weight.

Suitable thermoplastic polymeric binders have molecular weights greater than 10,000 and soften above 40° C.

A. Copolyesters, e.g., those prepared from the reaction product of a polymethylene glycol of the formula $HO(CH_2)_nOH$, wherein $n$ is a whole number 2 to 10 inclusive, and (1) hexahydroterephthalic, sebacic and terephthalic acids, (2) terephthalic, isophthalic and sebacic acids, (3) terephthalic and sebacic acids, (4) terephthalic and isophthalic acids, and (5) mixtures of copolyesters prepared from said glycols and (i) terephthalic, isophthalic, sebacic and adipic acids.

B. Nylons or polyamides, e.g., N-methoxymethyl polyhexamethylene adipamide;

C. Vinylidene chloride copolymers, e.g., vinylidene chloride/acrylonitrile; vinylidene chloride/methacrylate and vinylidene chloride/vinylacetate copolymers;

D. Ethylene/vinyl acetate copolymers;

E. Cellulosic ethers, e.g., methyl cellulose, ethyl cellulose and benzyl cellulose;

F. Polyethylene;

G. Synthetic rubbers, e.g., butadiene/acrylonitrile copolymers, and chloro-2-butadiene-1,3-polymers;

H. Cellulose esters, e.g., cellulose acetate, cellulose acetate succinate and cellulose acetate butyrate;

I. Polyvinyl esters, e.g., polyvinyl acetate/acrylate, polyvinyl acetate/methacrylate and polyvinyl acetate;

J. Polyacrylate and alpha-alkyl polyacrylate esters, e.g., polymethyl methacrylate and polyethyl methacrylate; as well as acrylic ester/acrylic acid copolymers;

K. High molecular weight polyethylene oxides of polyglycols having average molecular weights from about 4,000 to 1,000,000;

L. Polyvinyl chloride and copolymers, e.g., polyvinyl chloride/acetate;

M. Polyvinyl acetal, e.g., polyvinyl butyral, polyvinyl formal;

N. Polyformaldehydes;

O. Polyurethanes;

P. Polycarbonates;

Q. Polystyrene.

To the thermoplastic polymer matrix of the photopolymerizable composition there can be added nonthermoplastic polymeric compounds to improve certain desirable characteristics, e.g., adhesion to the base support, adhesion to the image-receptive support on transfer, wear properties, chemical inertness, etc. Suitable nonthermoplastic polymeric compounds include polyvinyl alcohol, cellulose, anhydrous gelatin, phenolic resins and melamineformaldehyde resins, etc. Such materials are used in amounts varying with the desired properties of the photopolymerizable layer.

A preferred class of free-radical generating addition polymerization initiators activatable by actinic light and thermally inactive at and below 185° C includes the substituted or unsubstituted polynuclear quinones which are compounds having two intracyclic carbonyl groups attached to intracyclic carbon atoms in a conjugated carbocyclic ring system. Suitable such initiators include 9,10-anthraquinone, 1-chloro-anthraquinone, 2-chloro-anthraquinone, 2-methyl-anthraquinone, 2-ethyl-anthraquinone, 2-tert-butylanthraquinone, octamethylanthraquinone, 1,4-naphthoquinone, 9,10-phenanthrenequinone, 1,2-benzanthraquinone, 2,3-benzanthraquinone, 2-methyl-1,4-naphthoquinone, 2,3-dichloronaphthaquinone, 1,4-dimethylanthraquinone, 2,3-dimethylanthraquinone, 2-phenylanthraquinone, 2,3-diphenylanthraquinone, sodium salt of anthraquinone alpha-sulfonic acid, 3-chloro-2-methylanthraquinone, retenequinone, 7,8,9,10-tetrahydronaphthacenequinone, and 1,2,3,4-tetrahydrobenz(a)anthracene-7,12-dione. Other photoinitiators which are also useful, even though some may be thermally active at temperatures as low as 85° C, as described in Plambeck, U.S. Pat. No. 2,760,863 and include vicinal ketaldonyl compounds, such as diacetyl, benzil, etc.; $\alpha$-ketaldonyl alcohols, such as benzoin, pivaloin, etc.; acyloin ethers, e.g., benzoin methyl and ethyl ethers, etc.; $\alpha$-hydrocarbon substituted aromatic acyloins, including α-methylbenzoin, α-allylbenzoin, and α-phenylbenzoin.

Also suitable as photoinitiators are the 2,4,5-triphenylimidazolyl dimers disclosed in Chambers, U.S. Pat. No. 3,479,185, Nov. 18, 1969. Also useful are the photoinitiating combinations disclosed in British Pat. No. 1,090,142, as well as the combinations of Michler's ketone with 2,4,5-triphenylimidazolyl dimers disclosed in U.S. Pat. No. 3,549,367.

Suitable thermal polymerization inhibitors that can be used in photopolymerizable compositions include p-methoxyphenol, hydroquinone, and alkyl and aryl-substituted hydroquinones and quinones, tert-butyl catechol, pyrogallol, copper resinate, napthylamines, beta-naphthol, cuprous chloride. 2,6-di-tert-butyl p-cresol, phenothiazine, pyridine, nitrobenzene and dinitrobenzene. Other useful inhibitors include p-toluquinone and chloranil.

The elements of this invention comprises a layer of the composition, preferably coated on a plastic film support. The elements are conveniently prepared by dissolving the components of the composition is a volatile solvent such as acetone or a low molecular weight alcohol, coating the solution on the plastic film support by skim coating, doctor blade coating or other conventional coating technique, and allowing the solvent to evaporate.

The support may be any suitable polymeric film or paper. For example, the cellulosic supports, e.g., cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. The film formed from the polyesterification product of a dicarboxylic acid and a dihydric alcohol made according to the teachings of Alles, U.S. Pat. No. 2,779,684 and the patents referred to in the specification of that patent is suitable. Other suitable supports are the polyethylene terephthalate/isophthalates of British Pat. No. 766,290 and Canadian Pat. No. 562,672 and those obtainable by condensing terephthalic acid and dimethyl terephthalate with propylene glycol, diethylene glycol, tetramethylene glycol or cyclohexame 1,4-dimethanol(hexahydro-p-xylene alcohol). The films of Bauer et al., U.S. Pat. No. 3,052,543 may also be used. The above polyester films are particularly suitable because of their dimensional stability. Colored supports, e.g., black paper or black film, may also be used to give a white on black image.

In use, the element of this invention is exposed through a positive process transparency with a source of actinic radiation capable of initiating photohardening of the photohardenable layers of the element. The exposed element is then heated by means of heated rolls, hot platens, infrared radiation, or other means of heating to a temperature high enough to vaporize or decompose the blowing agent and soften the thermoplastic stratum. The temperature required will depend on the choice of thermoplastic binders and blowing agents but will in general be above 75° C and is conveniently about 90° – 125° C.

Since free-radical generating addition-polymerization initiators activatable by actinic radiation generally exhibit their maximum sensitivity in the ultraviolet range, the radiation source should usually furnish an effective amount of this radiation. Such sources include carbon arcs, mercury-vapor arcs, fluorescent lamps with ultraviolet radiation-emitting phosphors, argon glow lamps, electronic flash units and photographic flood lamps. Of these, the mercury-vapor arcs are customarily used at a distance of one and one-half to 20 inches from the photopolymerizable layer. It is noted, however, that in certain circumstances it may be advantageous to expose with visible light, using a photoinitiator sensitive in the visible region of the spectrum, e.g., 9,10-phenanthrenequinone or a combination of a sensitizing dye such as methylene blue with an initiator. In such cases, the radiation source should furnish an effective amount of visible radiation. Many of the radiation sources listed above furnish the required amount of visible light.

The following examples will illustrate preferred embodiments of this invention but are not intended to limit its scope.

EXAMPLE I

The following solution was prepared:

| | | |
|---|---|---|
| Methanol-water mixture (50/50 volume per cent) | 25 | ml |
| Polymethyl methacrylate solution (low molecular weight, inherent viscosity 0.20, 25% by weight solution in acetone) | 25 | ml |
| 4-Ketobenzotriazine | 1 | g |
| Polyethylene glycol diacrylate (average molecular weight = 408) | 5 | ml |
| 2-Ethylanthraquinone | 0.5 | g |
| Nonylphenoxypolyethoxy phosphate | 0.5 | g |

The solution was coated with a 2 mil doctor knife on a polyethylene terephthalate film support made according to Example IV of Alles, U.S. Pat. No. 2,779,684, and allowed to dry. A sample of the dried element was exposed through a positive process transparency for 5 minutes using carbon arc light source at a distance of 18 inches. The exposed sample was heated on a hot platen to 120° C. A vesicular image was observed having bubbles in the unexposed areas of the sample.

EXAMPLE II

The following solution was prepared:

| | | |
|---|---|---|
| 4-Ketobenzotriazine (dissolved in 50 ml of dioxane) | 2 | g |
| Polymethylmethacrylate solution (low molecular weight, inherent viscosity 0.20, 25% by weight solution in acetone) | 25 | ml |
| Copolymer of methyl methacrylate, acrylonitrile, and acrylated glycidyl acrylate in a ratio of 65/10/25 mole per cent | 2.0 | g |
| 9,10-Phenanthrenequinone | 0.5 | g |
| Polyoxyethylene (4) lauryl ether | 0.5 | g |
| Polyethylene glycol diacrylate (average molecular weight 408) | 10 | ml |

The solution was coated and dried as in Example I. A sample of the element so prepared was exposed and processed as in Example I. A vesicular image was obtained which could be used for a projection positive.

EXAMPLE III

The following solution was prepared:

| | | |
|---|---|---|
| Polymethylmethacrylate solution (low molecular weight, inherent viscosity 0.20, 25% by weight solution in acetone) | 25 | ml |
| Polyethylene glycol diacrylate (average molecular weight 408) | 5 | ml |
| Sodium oxalate | 10 | g |
| 9,10-Phenanthrenequinone | 0.1 | g |
| Solution of a copolymer of methyl methacrylate, acrylonitrile, and acrylated glycidyl acrylate in a ratio of 65/10/25 mole per cent (25% by weight in acetone) | 5 | ml |

The solution was coated and dried as in Example I, then a 1 mil thick cover sheet of polyethylene terephthalate film was laminated to the coating. A sample of the element was exposed as in Example I except that the exposure was for 1 minute. The exposed sample was heated as in Example I and a vesicular image having unexposed, white (frosty) image areas was obtained.

EXAMPLE IV

Example II was repeated except that pentaerythritol triacrylate was used in place of the polyethylene glycol diacrylate of that example. A vesicular image was obtained in the unexposed area, which image was white.

EXAMPLE V

Example II was repeated except that trimethylolpropane ethylene oxide adduct triacrylate (Example I of U.S. Pat. No. 3,380,831) was used in place of the polyethylene glycol diacrylate of that example. A vesicular image was obtained, wherein the unexposed areas were white.

EXAMPLE VI

Several compositions were prepared according to the following formula:

EXAMPLE VI

Several compositions were prepared according to the following formula:

| | | |
|---|---|---|
| 10% Aqueous gelatin solution | 300 | g |
| 10% Aqueous gum arabic solution | 10 | ml |
| 9,10-Phenanthrenequinone (dissolved in the minimum amount of ethanol | 0.5 | g |
| Pentaerythritol triacrylate | 5 | g |
| Nonylphenoxypolyethoxyphosphate | 0.5 | g |
| Benzyl alcohol | 0.5 | g |

EXAMPLE VI-continued

| | | |
|---|---|---|
| Blowing agent | 1.0 | g |

The blowing agents used were ammonium carbonate monohydrate, ammonium bicarbonate monohydrate, ammonium citrate, ammonium tartrate, ammonium sulfate monohydrate, and ammonium thiocarbamate.

Each solution was coated and dried as in Example I. Samples of each element were exposed and processed as in Example I. In each case a vesicular image was obtained having the unexposed areas frosty or white.

Other embodiments of the invention employing various blowing agents and photohardenable materials will be apparent to those skilled in the art.

We claim:

1. An element comprising a support bearing at least one solid photohardenable layer that softens at 40° to 220° C. and is capable of forming a positive vesicular image, said layer comprising (a) about 60 to 99% by weight of at least one thermoplastic ethylenically unsaturated photohardenable material and (b) in admixture with said photohardenable material, about 1 to 40% by weight of a blowing agent which, when heated to at least 75° C., produces gas bubbles in areas of said layer which are not photohardened, said blowing agent being stable to actinic radiation by which said photohardenable material is photohardened.

2. An element according to claim 1 wherein said photohardenable material is comprised of 10 to 50% by weight of at least one non-gaseous, addition-polymerizable, ethylenically unsaturated compound having a boiling point about 100° C. at normal atmospheric pressure and being capable of forming a high polymer by photoinitiated addition polymerization and 30 to 80% by weight of at least one film-forming thermoplastic polymer binder, said blowing agent being stable to actinic light by which said layer is polymerizable.

3. An element according to claim 2, wherein said blowing agent is 4-ketobenzotriazine.

4. An element according to claim 2, wherein said blowing agent is sodium oxalate.

5. An element according to claim 2, wherein the ethylenically unsaturated compound is a polyethylene glycol diacrylate.

6. An element according to claim 2, wherein the ethylenically unsaturated compound is pentaerythritol triacrylate.

7. An element according to claim 2 containing an initiating amount of a free-radical generating addition polymerization initiator activatable by actinic light and thermally inactive at and below 185° C.

8. An element according to claim 2, wherein said polymer binder is a methyl methacrylate-containing polymer.

9. An element according to claim 1, wherein said support is colored.

* * * * *